US008833273B2

(12) United States Patent
Helle

(10) Patent No.: US 8,833,273 B2
(45) Date of Patent: Sep. 16, 2014

(54) TABLE DEVICE

(76) Inventor: Adne Helle, Stavanger (NO)

( * ) Notice: Subject to any disclaimer, the term of this patent is extended or adjusted under 35 U.S.C. 154(b) by 127 days.

(21) Appl. No.: 13/389,984

(22) PCT Filed: Aug. 6, 2010

(86) PCT No.: PCT/NO2010/000298

§ 371 (c)(1),
(2), (4) Date: Mar. 14, 2012

(87) PCT Pub. No.: WO2011/021939

PCT Pub. Date: Feb. 24, 2011

(65) Prior Publication Data

US 2012/0279427 A1 Nov. 8, 2012

(30) Foreign Application Priority Data

Aug. 17, 2009 (NO) ..... 20092843

(51) Int. Cl.

*A47B 11/00* (2006.01)
*A47B 13/08* (2006.01)
*A47B 91/00* (2006.01)

(52) U.S. Cl.

CPC ..... *A47B 11/00* (2013.01); *A47B 13/081* (2013.01); *A47B 91/005* (2013.01)
USPC ..... 108/142

(58) Field of Classification Search

USPC ..... 108/50.12, 139–142; 312/249.2–249.7; 248/458, 521, 125.7, 125.9, 130, 131, 248/415–418, 425, 349.1
See application file for complete search history.

(56) References Cited

U.S. PATENT DOCUMENTS

| | | | | | |
|---|---|---|---|---|---|
| 2,104,072 | A * | 1/1938 | Carr | 248/458 |
| 2,364,516 | A * | 12/1944 | Buckstaff | 248/425 |
| 2,526,245 | A * | 10/1950 | Lathrop | 108/28 |
| 3,911,509 | A * | 10/1975 | Fleckenstein | 5/507.1 |
| 6,089,167 | A * | 7/2000 | Frohardt | 108/94 |
| 6,315,252 | B1 * | 11/2001 | Schultz | 248/160 |
| 6,877,442 | B2 | 4/2005 | Helle | |
| 2002/0017595 | A1 * | 2/2002 | Koyanagi | 248/122.1 |

FOREIGN PATENT DOCUMENTS

NO 309551 B1 2/2001

OTHER PUBLICATIONS

International Search Report and Written Opinion for parent application PCT/NO2010/000298, having a mailing date of Oct. 21, 2010.

* cited by examiner

*Primary Examiner* — Darnell Jayne
*Assistant Examiner* — Timothy M Ayres
(74) *Attorney, Agent, or Firm* — Andrus Intellectual Property Law, LLP

(57) ABSTRACT

A table device comprises a base, a footing and a tabletop. The base is designed with an upper portion, which is rotatable relative to a lower portion in the horizontal plane. The lower portion of the base is arranged to abut a basis. The upper portion of the base is provided with two diametrically opposite castors abutting rollably the lower portion of the base. A friction element arranged to be able to abut the lower portion of the base, is connected to the upper portion of the base outside an axis extending between the two castors.

24 Claims, 8 Drawing Sheets

IV-IV

IV-IV

VII-VII

IX-IX

IX-IX

TABLE DEVICE

CROSS-REFERENCE TO RELATED APPLICATIONS

This application is the U.S. national stage application of International Application No. PCT/NO2010/000298, filed Aug. 6, 2010, which International application was published on Feb. 24, 2011 as International Publication No. WO 2011/021939 A1 in the English language and which application is incorporated herein by reference. The International application claims priority of Norwegian Patent Application No. 20092843, filed Aug. 17, 2009, which application is incorporated herein by reference.

BACKGROUND

This invention relates to a table. More particularly it concerns a table comprising a base, a footing and a tabletop, and where the base is formed with an upper portion being rotatable in the horizontal plane relative to a lower portion, and where the lower portion of the base is arranged to abut a basis.

During use of such as a personal computer in conjunction with such as an armchair, it is often desirable to be able to pull is the table in over the armchair after one is seated.

It is known to use a table with wheels where the table is displaced on the floor to place the tabletop in an operating position extending in over the chair.

Norwegian patent 309551 concerns a table where a tabletop is doubly hinged in the horizontal plane. The tabletop is thereby arranged to be able to be turned in over such as a chair, at the same time as the distance relative to the table base may be adjusted.

Prior art devices may have a drawback in that they do not have sufficient braking effect and thereby have a tendency to be displaced unintentionally during use.

Known devices for the purpose are neither adapted for tilting the tabletop.

SUMMARY

The object of the invention is to remedy or reduce at least one of the disadvantages of the prior art.

The object is achieved by the features disclosed in the following description and in the subsequent claims.

There is provided a table comprising a base, a footing and a tabletop, the base being formed with an upper portion being rotatable in the horizontal plane relative to a lower portion, where a lower portion of the base is arranged to abut a basis. The table is characterised in that an upper portion of the base is provided with two diametrically opposite castors abutting rollably against the lower portion of the base, and where a friction element arranged to be able to abut the lower portion of the base, is connected to the upper portion of the base and outside an axis extending between the two castors.

The upper portion of the base is thus arranged to be able to be tilted about the two castors relative to the lower portion of the base. By the friction element being outside the axis between the two castors, the friction element may abut the lower portion of the base, for example when the tabletop is in its operating position, but be tilted up from the lower portion of the base when the tabletop is in a resting position. The friction element will thus brake any displacement between the upper and lower portions of the base when the table is in the operating position, but be inactive when it is lifted up from the lower portion of the base.

The upper portion of the base may be provided with a third castor on the opposite side of the axis relative to the friction element. The third castor effects that the upper portion of the base in a more stable way may be rotated relative to the lower portion of the base.

The upper portion of the base may be provided with a counterweight close to the third castor. The counterweight is arranged to hold the table in a stable position against a basis, and to facilitate rotation of the upper portion of the base relative to the lower portion of the base, as the counterweight contributes to hold the friction element lifted from the lower portion of the base.

In this preferred embodiment example the footing is attached to the upper portion of the base.

In an alternative embodiment both the footing and the friction element may be connected to, relative to the upper portion of the base, a pivotal attachment. In this embodiment it is sufficient that just the attachment is tilted or lifted to lift the friction element up from the lower portion of the base.

This embodiment is well suited for tables where the castors are replaced by such as a turntable.

The footing may be rotatable about its vertical axis at its fastening to the upper portion of the base or at the attachment. The footing may be provided with a toothed ring complementary fitting in a releasable locking body. The locking body is displaceable between an active locking position and an inactive released position.

The locking body may be provided with a friction element arranged to be able to abut the lower part of the base to thereby brake both the rotation of the footing about its attachment and the rotation of the upper portion of the base about the lower portion of the base. The friction element holds the locking body in its active position when the friction element abuts the lower portion of the base.

The tabletop may be connected to the footing by means of a ball attachment. It is thereby a simple operation to adjust the tabletop to the desired angle and thereafter to lock the tabletop in this angle. Other attachment means between the footing and the tabletop may also be appropriate, e.g. an axle suspension where the tabletop is rotatable about a horizontal axis.

The tabletop and the base may be made in appropriate shapes, but the most appropriate seems to be circular.

Advantageously the footing is given a U- or bow-shape. The tabletop may thereby be lowered further down than for example the height of an armrest. This is particularly important when the tabletop is to be tilted. The shape of the footing also makes the tabletop obtain a distance to the vertical portion of the footing, making room for the armrest. The footing being connected to the tabletop from above renders in all material aspects the extension from the underside of the tabletop superfluous. Advantageously the footing is placed eccentrically on the base.

The invention makes production of relatively light, steady tables that are prevented from unintentional rotation from the desired position possible. The locking mechanism is also suitable for heavier tables where it is desirable that the table is rotatable at the same time as it must be able to be kept fixed in a desired position.

BRIEF DESCRIPTION OF THE DRAWINGS

In the following is described an example of a preferred embodiment illustrated in the accompanying drawings, wherein.

DETAILED DESCRIPTION OF THE DRAWINGS

Figure 1:
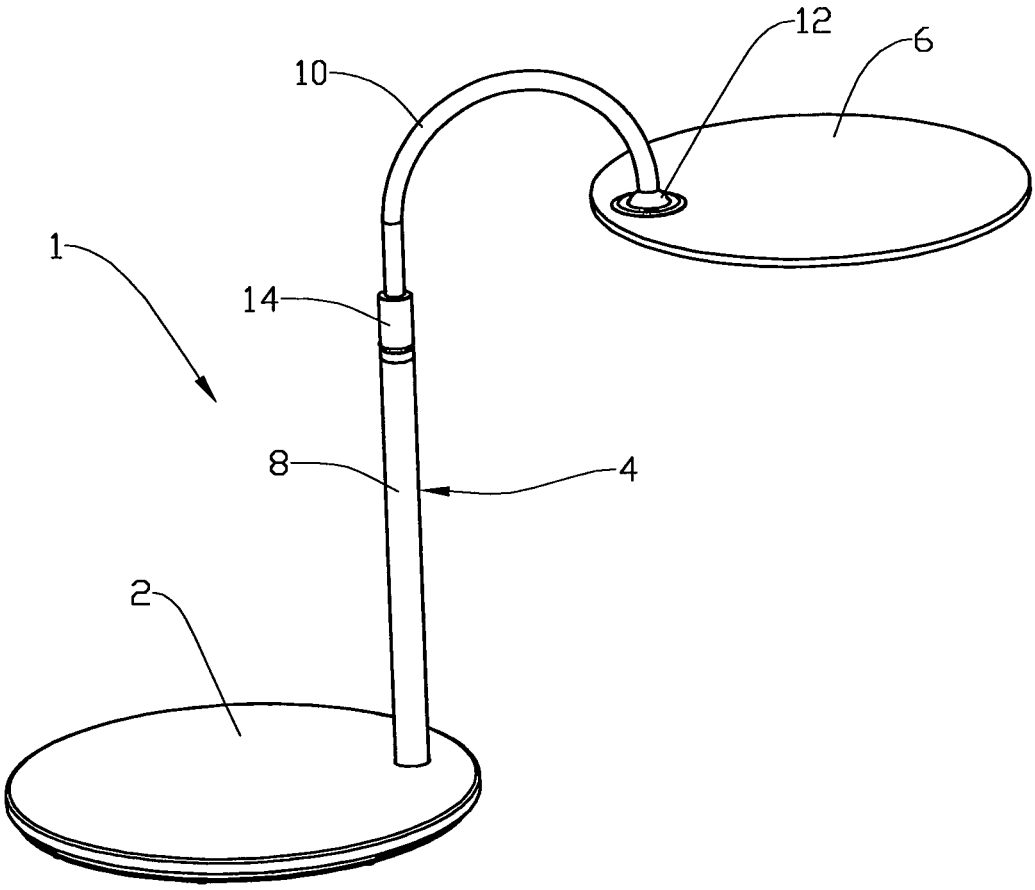
FIG. 1 shows in perspective a table according to the invention in an operating position.
Figure 2:
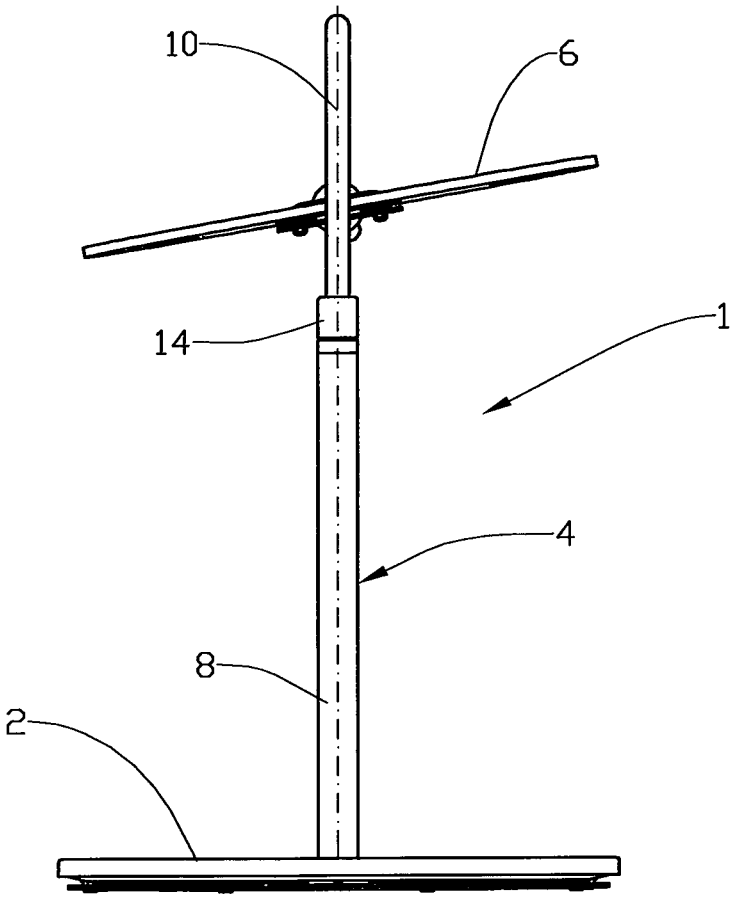
FIG. 2 shows a side view of the table in FIG. 1, but with a somewhat tilted tabletop.
Figure 3:
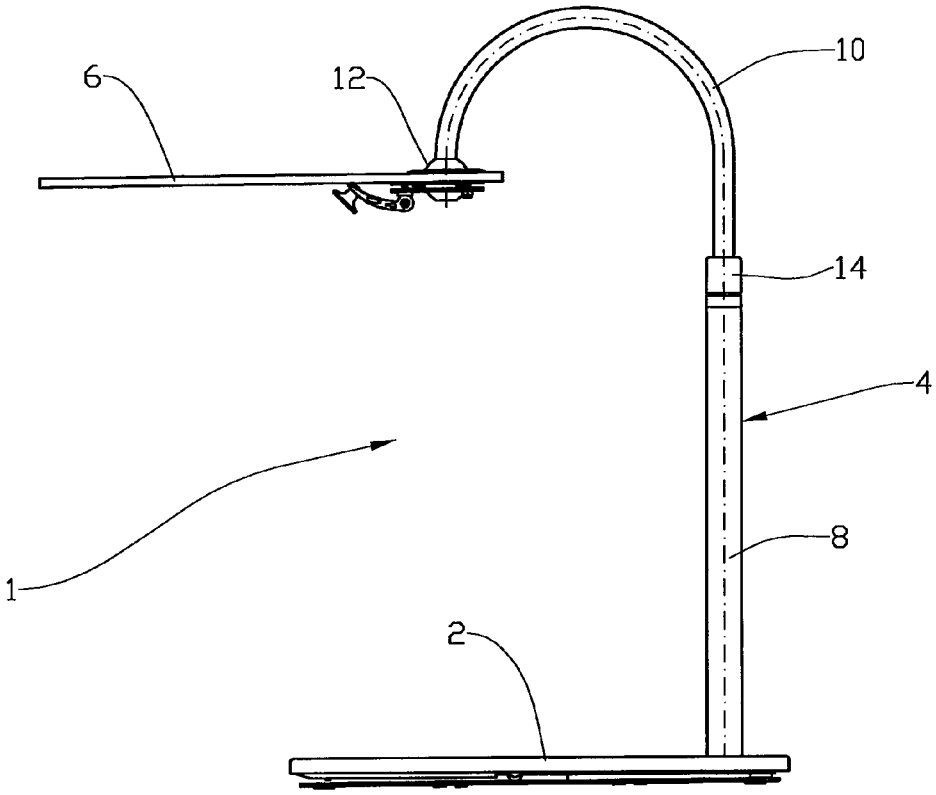
FIG. 3 shows a side view of the table where the tabletop of the table is in an inward rotated position.

In the drawings the reference numeral 1 indicates a table comprising a base 2, a footing 4 and a tabletop 6. The footing 2 is telescopic, as a lower tubular 8 is attached to the base 2 while an upper tubular 10 is displaceable in the lower tubular 8. The upper tubular is given a U-shape and is connected to the tabletop 6 by means of a ball attachment 12. An adapter sleeve connection 14 of a per se known design connected to the lower tubular 8 clamps the upper tubular 10.

Figure 4:
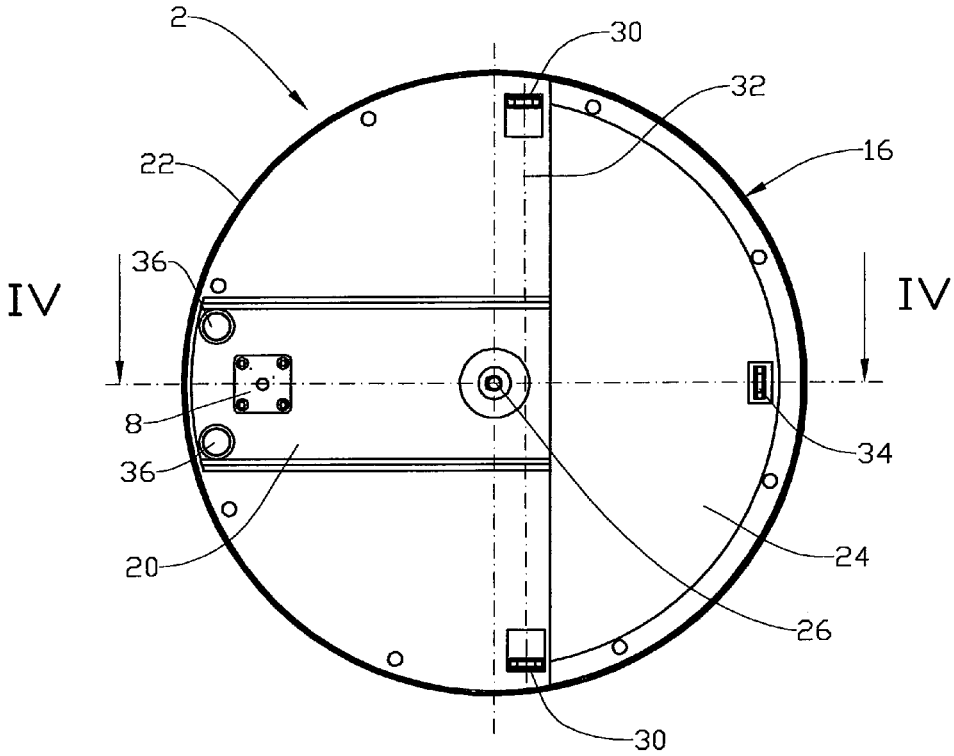
FIG. 4 shows a view from the underside of the base where the lower portion of the base is removed.
Figure 5:
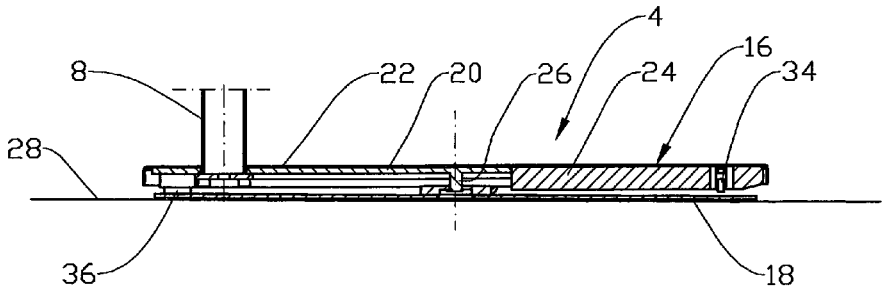
FIG. 5 shows a section IV-IV in FIG. 4.
Figure 6:
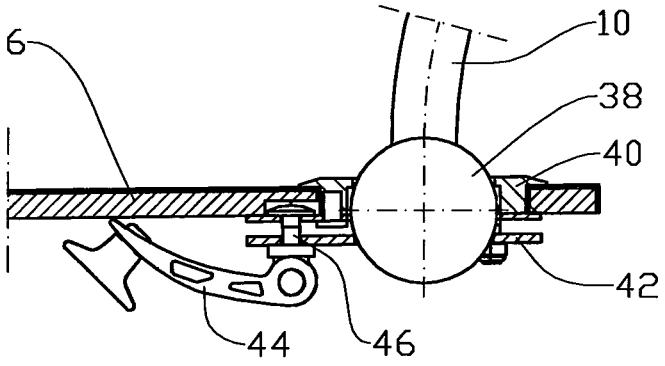
FIG. 6 shows a section of a ball attachment in the tabletop.

The base 2 comprises an upper portion 16 and a lower portion 18, see FIGS. 4 and 5. The lower portion 18 is not shown in FIGS. 4 and 7. The upper portion 16 of the base comprising a support plate 20, a cover plate 22 and a counterweight 24, is by means of a stub shaft 26 rotatably connected to the lower portion 18 of the base. The lower portion 18 of the base 2 is arranged to be able to lie on a basis 28.

The lower tubular 8 of the footing 4 is bolted to the support plate 20. Two castors 30 are arranged diametrically opposite under the upper portion 16 of the base, see FIG. 4. An axis 32 runs between the castors 30.

A third castor 34 is arranged at the counterweight 24. The castors 30, 34 are arranged to be able to roll against the lower portion 18 of the base when the upper portion 16 of the base is rotated.

Diametrically opposite the third castor 34 and to the upper portion 16 of the base, more particularly to the support plate 20, are attached two friction elements 36. The friction elements 36 are arranged to be able to abut brakingly the lower portion 18 of the base when the friction element 36 is in its lower position.

In this preferred embodiment the friction elements 36 abut the lower portion 18 of the base when a sufficient moment is applied to the footing 4 about the axis 32 to tilt the counterweight 24 up. The friction elements 36 thereby counteract rotation of the upper portion 16 of the base about the lower portion 18 of the base.

By lifting the tabletop 6 somewhat, or by turning the tabletop 6 to its inward turned position so that the table centre of gravity is on the counterweight side of the axis 32, the upper portion 16 of the base is tilted about the axis 32. The friction elements 36 are lifted up from the lower portion 18 of the base, whereby the upper portion 16 of the base may be turned freely relative to the lower portion 18 of the base.

The ball attachment 12 comprises a ball 38 attached to the upper tubular 10 of the base. The ball 38 is clamped between a first clamp plate 40 attached to the tabletop 6, and a second tensional clamping plate 42. An adjustable over centre handle 44 is connected to a clamping bolt 46 and is arranged to be able to squeeze the clamping plates 40, 42 together and thereby locking the ball attachment 12 in the desired position.

Figure 7:
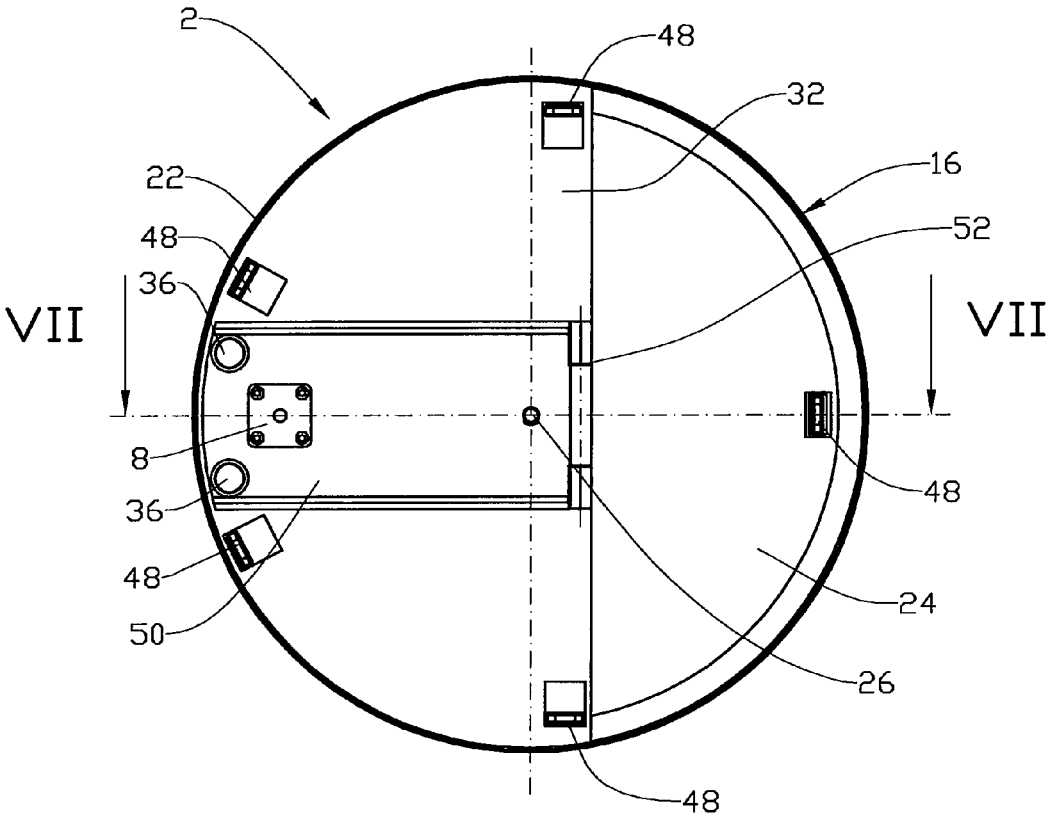
FIG. 7 shows a view from the underside of the base in an alternative embodiment.
Figure 8:
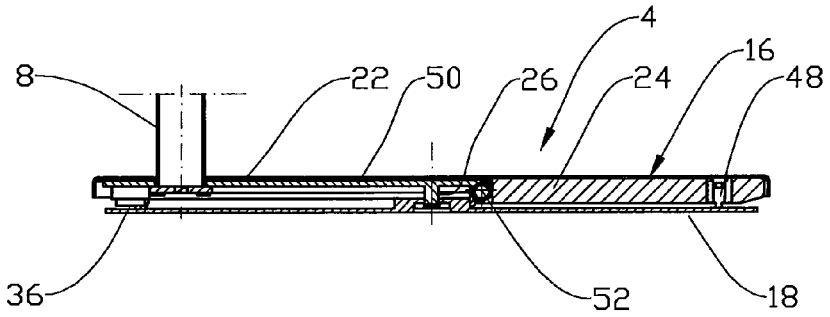
FIG. 8 shows a section VII-VII in FIG. 7.

In an alternative embodiment, see FIGS. 7 and 8, the lifting of the friction elements 36 up from the lower portion 18 of the base is carried out without tilting the whole upper portion 16 of the base.

The upper portion 16 of the base is provided with a number of distributed castors 48 and is therefore prevented from being able to tilt relative to the lower portion 18 of the base.

Both the footing 4, i.e. the lower tubular 8 of the base, and the friction elements 36 are attached to fastener 50 which by means of a bolt 52 is linkably attached to the upper portion 16 of the base.

Lifting and lowering of the friction elements 36 are here done by turning the footing 4 about the bolt 52.

Figure 9:
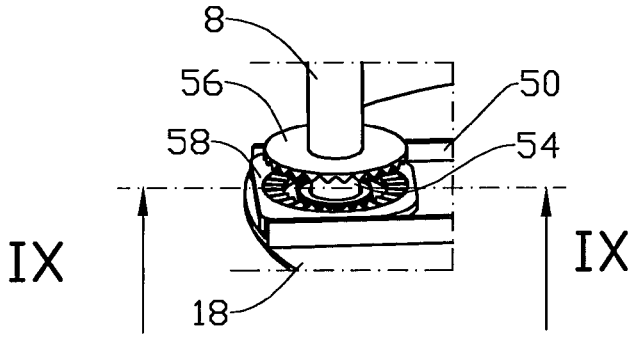
FIG. 9 shows in perspective an alternative attachment of the table column to the base.
Figure 10:
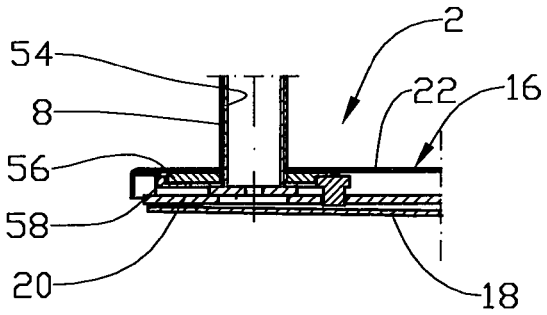
FIG. 10 shows a section IX-IX in FIG. 9.
Figure 11:
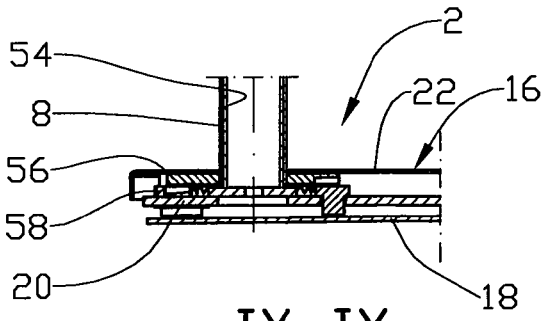
FIG. 11 shows a section IX-IX in FIG. 9, but in a released position.

In a further embodiment, see FIGS. 9-11, the footing 4 is formed with an inner guide tube 54 connected to the upper portion 16 of the base. The lower tubular 8 of the base, being rotatable about the guide tube 54, is here connected to a toothed ring 56 encircling the lower tubular 8 of the base just under the cover plate 22. In FIG. 9 where the cover plate 22 is removed, the lower tubular 8 of the base and the toothed ring 56 are for illustrative reasons lifted somewhat up from the rest of the components.

The toothed ring 56 fits complementary in a locking body 58, which is lift- and lowerable relative to the upper portion 16 of the base.

By arranging the friction elements 36 on the underside of the locking body 58 the locking body 58 is held meshed with the toothed ring 56, see FIG. 10, when the friction elements 36 abut brakingly against the lower portion 18 of the base, which happens when a load from the footing 4 overcomes the moment from the counterweight bringing the upper portion of the base to tilt about the axis 32, see FIG. 4.

If desirable the locking element 58 may be arranged in a rotatable attachment 50 corresponding to what is explained under reference to FIGS. 7 and 8.

Figure 12:
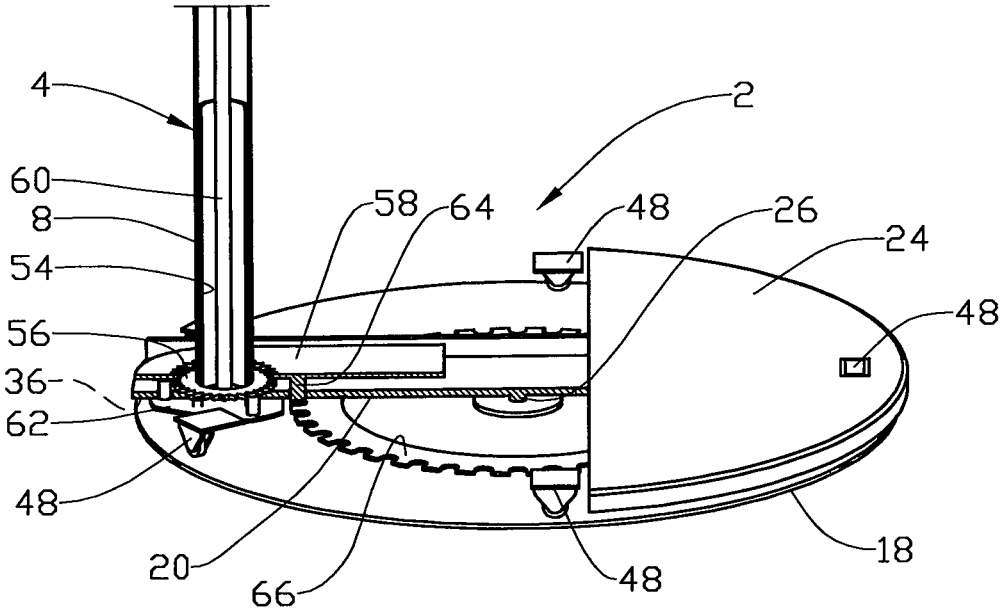
FIG. 12 shows a segment of the base in an alternative embodiment.

In yet another embodiment, see FIG. 12 where the cover plate 22 is removed, the locking body 58 is releasable by means of a tripping rod 60, which via a tripping body 62 is arranged to be able to move the locking body 58 between a lifted released position and a lowered locking position.

The locking body 58 is provided with a hook 64 arranged to be able to grip a cam ring 66. The cam ring 66 is attached to the lower portion 18 of the base.

In FIG. 12 the locking body 58 is shown in its released position, where it is out of mesh with the toothed ring 56, and where also the hook is out of mesh with the cam ring 66.

When the trigger rod 60 is lowered, the trigger body 62 and the locking body 58 are also displaced downwards, whereby the locking body 58 meshes with the toothed ring 65 and the hook 64 meshes with the cam ring 66.

The invention claimed is:

1. A table device comprising:

a base, a tabletop, and a footing that supports the tabletop above the base, wherein the base comprises an upper portion and a lower portion, the upper portion being rotatable in a horizontal plane relative to the lower portion;

two casters that support rotation of the upper portion relative to the lower portion, wherein the two casters rollably abut the lower portion and are disposed on opposite sides of a rotational center of the upper portion; and a friction element connected to the upper portion outside of a pivot axis that extends between the two castors, wherein the friction element abuts the lower portion of the base when the upper portion is pivoted about the pivot axis with respect to the lower portion;

wherein the upper portion comprises a support plate, a cover plate and a counterweight, wherein the counterweight is disposed on an opposite side of the pivot axis relative to the friction element;

wherein the friction element abuts the lower portion when a moment is applied to the footing that tilts the counterweight about the pivot axis away from the lower portion, and wherein the friction element counteracts rotation of the upper portion with respect to the lower portion;

wherein the tabletop is turnable with respect to the base between an inward position and an outward position; and wherein turning the tabletop to the inward position so that a center of gravity of the tabletop is on a same side of the pivot axis as the counterweight causes the upper portion to tilt about the pivot axis and move the friction element away from the lower portion, thus allowing rotation of the upper portion with respect to the lower portion.

2. The device according to claim 1, comprising a third caster that supports rotation of the upper portion with respect to the lower portion, the third caster being disposed on an opposite side of the pivot axis relative to the friction element.

3. The device according to claim 1, wherein the tabletop comprises a top side and an opposite, bottom side, and wherein the footing is connected to the top side.

4. The device according to claim 1, wherein the footing comprises a lower tubular attached to the base and an upper tubular attached to the tabletop, wherein the upper and lower tubulars are attached to each other such that at least one of the upper and lower tubulars is telescopically displaceable with respect to the other of the upper and lower tubulars.

5. The device according to claim 4, comprising an adapter sleeve connecting the lower tubular and upper tubular.

6. The device according to claim 4, wherein the upper tubular is U-shaped.

7. The device according to claim 1, comprising a ball attachment connecting the tabletop to the footing.

8. The device according to claim 7, wherein the ball attachment comprises a ball attached to a tubular of the footing.

9. The device according to claim 8, wherein the ball is clamped between a first clamp plate attached to the tabletop and a tensional second clamp plate.

10. The device according to claim 9, comprising an over center handle connected to a clamping bolt, wherein pivoting of the over center handle with respect to the clamping bolt clamps the first and second clamp plates together and locks the ball in a rotational position with respect to the tabletop.

11. A table device comprising:

a base, a tabletop, and a footing that supports the tabletop above the base, wherein the base comprises an upper portion and a lower portion, the upper portion being rotatable relative to the lower portion about a vertical rotation axis and being pivotable relative to the lower portion about a horizontal pivot axis;

first and second casters that support rotation of the upper portion relative to the lower portion about the rotation axis and that support pivoting of the upper portion relative to the lower portion about the pivot axis, wherein the first and second casters are disposed on opposite sides of the rotation axis, respectively;

wherein the footing is connected to the upper portion on a first side of the pivot axis;

a friction element disposed between the upper and lower portions on the first side of the pivot axis, the friction element braking relative rotation between the upper and lower portions about the rotation axis; and a counterweight to the footing, the counterweight disposed on an opposite, second side of the pivot axis with respect to the footing;

wherein pivoting of the upper portion and footing about the pivot axis in a first direction engages the friction element between the upper and lower portions and thereby prevents relative rotation between the upper and lower portions, and wherein pivoting of the footing and upper portion about the pivot axis in an opposite, second direction disengages the friction element and thereby allows relative rotation between the upper and lower portions about the rotation axis.

12. The device according to claim 11, comprising a third caster that supports rotation of the upper portion with respect to the lower portion about the rotation axis, the third caster being disposed on the second side of the pivot axis.

13. The device according to claim 11, wherein the third caster is diametrically opposite the friction element.

14. The device according to claim 11, wherein the tabletop comprises a top side and an opposite, bottom side, and wherein the footing is connected to the top side.

15. The device according to claim 11, wherein the footing comprises a lower tubular attached to the base and an upper tubular attached to the tabletop, wherein the upper and lower tubulars are attached to each other such that at least one of the upper and lower tubulars is telescopically displaceable with respect to the other of the upper and lower tubulars.

16. The device according to claim 15, comprising an adapter sleeve connecting the lower tubular and upper tubular.

17. The device according to claim 15, wherein the upper tubular is U-shaped.

18. The device according to claim 11, wherein the friction element is disposed on the upper portion and abuts the lower portion when a moment is applied to the footing that tilts the counterweight about the pivot axis away from the lower portion.

19. The device according to claim 18, wherein the tabletop is turnable with respect to the base between an inward position and an outward position; and wherein turning the tabletop to the inward position so that a center of gravity of the tabletop is on a same side of the pivot axis as the counterweight causes the upper portion to tilt about the pivot axis and move the friction element away from the lower portion, thus allowing rotation of the upper portion with respect to the lower portion.

20. The device according to claim 11, comprising a ball attachment connecting the tabletop to the footing.

21. The device according to claim 20, wherein the ball attachment comprises a ball attached to a tubular of the footing.

22. The device according to claim 21, wherein the ball is clamped between a first clamp plate attached to the tabletop and a tensional second clamp plate.

23. The device according to claim 22, comprising an over center handle connected to a clamping bolt, wherein pivoting of the over center handle with respect to the clamping bolt clamps the first and second clamp plates together and locks the ball in a rotational position with respect to the tabletop.

24. A table device comprising:

a base, a tabletop, and a footing that supports the tabletop above the base, wherein the base comprises an upper portion and a tower portion, the upper portion being rotatable relative to the lower portion about a vertical rotation axis and being pivotable relative to the tower portion about a horizontal pivot axis;

first and second casters that support rotation of the upper portion relative to the lower portion about the rotation axis and that support pivoting of the upper portion relative to the lower portion about the pivot axis, wherein the first and second casters are disposed on the pivot axis and on opposite sides of the rotation axis, respectively;

wherein the footing is connected to the upper portion on a first side of the pivot axis;

a friction element disposed between the upper and lower portions on the first side of the pivot axis, the friction element braking relative rotation between the upper and lower portions about the rotation axis;

a counterweight to the footing, the counterweight disposed on an opposite, second side of the pivot axis with respect to the footing;

wherein pivoting of the upper portion and footing about the pivot axis in a first direction engages the friction element between the upper and lower portions and thereby prevents relative rotation between the upper and lower portions, and wherein pivoting of the footing and upper portion about the pivot axis in an opposite, second direction disengages the friction element and thereby allows relative rotation between the upper and lower portions about the rotation axis;

wherein the footing comprises a lower tubular attached to the base and a U-Shaped upper tubular attached to the tabletop, wherein the upper and lower tubulars are attached to each other such that at least one of the upper and lower tubulars is telescopically displaceable with respect to the other of the upper and lower tubulars; and a ball attachment connecting the tabletop to the footing, wherein the ball attachment comprises a ball attached to a tubular of the footing.

* * * * *